US012104841B2

(12) United States Patent
Fang et al.

(10) Patent No.: US 12,104,841 B2
(45) Date of Patent: Oct. 1, 2024

(54) REFRIGERATOR AND METHOD AND DEVICE FOR CONTROLLING REFRIGERATION THEREOF

(71) Applicants: HEFEI MIDEA REFRIGERATOR CO., LTD., Anhui (CN); HEFEI HUALING CO., LTD., Anhui (CN); MIDEA GROUP CO., LTD., Guangdong (CN)

(72) Inventors: Ruiming Fang, Anhui (CN); Yu Li, Anhui (CN)

(73) Assignees: HEFEI MIDEA REFRIGERATOR CO., LTD., Anhui (CN); HEFEI HUALING CO., LTD., Anhui (CN); MIDEA GROUP CO., LTD., Guangdong (CN)

( * ) Notice: Subject to any disclaimer, the term of this patent is extended or adjusted under 35 U.S.C. 154(b) by 418 days.

(21) Appl. No.: 17/420,286

(22) PCT Filed: Jan. 9, 2019

(86) PCT No.: PCT/CN2019/070992
§ 371 (c)(1),
(2) Date: Jul. 1, 2021

(87) PCT Pub. No.: WO2020/142931
PCT Pub. Date: Jul. 16, 2020

(65) Prior Publication Data

US 2022/0090840 A1 Mar. 24, 2022

(51) Int. Cl.
*F25D 17/02* (2006.01)
*F25C 1/04* (2018.01)
(Continued)

(52) U.S. Cl.
CPC ..... *F25D 17/02* (2013.01); *F25C 1/04* (2013.01); *F25C 5/10* (2013.01); *F25D 11/022* (2013.01);
(Continued)

(58) Field of Classification Search
CPC ..... F25D 17/02; F25D 11/022; F25D 29/00; F25C 1/04; F25C 5/10; F25C 2400/10;
(Continued)

(56) References Cited

U.S. PATENT DOCUMENTS 7,681,406 B2 3/2010 Cushman et al.
8,484,987 B2 7/2013 Ducharme et al.
(Continued)

FOREIGN PATENT DOCUMENTS

CN 2833461 Y 11/2006
CN 100374799 C 3/2008
(Continued)

OTHER PUBLICATIONS

Office Action, dated Oct. 18, 2022, for Canadian Patent Application No. 3,126,296. (4 pages).
(Continued)

*Primary Examiner* — Emmanuel E Duke
(74) *Attorney, Agent, or Firm* — Seed IP Law Group LLP

(57) ABSTRACT

Disclosed are a refrigerator and a method and device for controlling refrigeration of the refrigerator. A refrigeration system of the refrigerator includes a refrigerating evaporator for refrigerating a refrigerating compartment, an ice-making evaporator for making ice in an ice machine, a refrigerating capillary tube adjacent to the refrigerating evaporator and an ice-making capillary tube adjacent to the ice-making evaporator, and a control valve for controlling the refrigerating capillary tube and the ice-making capillary tube. The method includes recognizing a current ice-making stage of the ice
(Continued)

machine, acquiring a current temperature of an ice-making compartment in the refrigerator, and controlling a connecting direction of the control valve according to the current ice-making stage and the current temperature.

21 Claims, 6 Drawing Sheets

(51) Int. Cl.
*F25C 5/10* (2006.01)
*F25D 11/02* (2006.01)

(52) U.S. Cl.
CPC ..... *F25C 2400/10* (2013.01); *F25C 2600/04* (2013.01); *F25C 2700/12* (2013.01)

(58) Field of Classification Search
CPC ..... F25C 2600/04; F25C 2600/2511; F25C 2700/12; F25B 5/02; F25B 5/22; F25B 41/37
See application file for complete search history.

(56) References Cited

U.S. PATENT DOCUMENTS

| | | | | |
|---|---|---|---|---|
| 2008/0072610 | A1* | 3/2008 | Venkatakrishnan | F25C 1/04 62/135 |
| 2008/0190125 | A1 | 8/2008 | Yoshioka et al. | |
| 2013/0025303 | A1 | 1/2013 | Yoon et al. | |
| 2018/0283758 | A1 | 10/2018 | Ding et al. | |
| 2018/0328642 | A1 | 11/2018 | McCollough et al. | |

FOREIGN PATENT DOCUMENTS

| | | | | |
|---|---|---|---|---|
| CN | 101405551 | A | 4/2009 | |
| CN | 201623866 | U | 11/2010 | |
| CN | 102213519 | A | 10/2011 | |
| CN | 202889671 | U | 4/2013 | |
| CN | 103575418 | A | 2/2014 | |
| CN | 203687340 | U | 7/2014 | |
| CN | 206131448 | U | 4/2017 | |
| CN | 106885419 | A | 6/2017 | |
| CN | 206410403 | U | 8/2017 | |
| CN | 107576117 | A * | 1/2018 | |
| CN | 207019365 | U | 2/2018 | |
| CN | 207831644 | U | 9/2018 | |
| CN | 108679900 | A | 10/2018 | |
| CN | 109764632 | A | 5/2019 | |
| EP | 2401564 | A2 | 1/2012 | |
| JP | H08261627 | A | 10/1996 | |
| JP | 10-255136 | A | 9/1998 | |
| JP | 2000292046 | A | 10/2000 | |
| JP | 2001221555 | A | 8/2001 | |
| JP | 2002022336 | A | 1/2002 | |
| JP | 2003-130519 | A | 5/2003 | |
| JP | 3545617 | B2 | 7/2004 | |
| KR | 10-2012-0084095 | A | 7/2012 | |
| KR | 10-2016-0051226 | A | 5/2016 | |
| KR | 10-2016-0053853 | A | 5/2016 | |
| KR | 20170112666 | A * | 10/2017 | F25C 7/08 |
| WO | 2010099439 | A2 | 9/2010 | |
| WO | 2015/194707 | A1 | 12/2015 | |
| WO | 2018/041517 | A1 | 3/2018 | |

OTHER PUBLICATIONS

Office Action dated Feb. 23, 2023, for the corresponding Chinese Patent Application No. 201711041044.9, 22 pages. (With English Translation).
Office Action dated May 30, 2023, for the corresponding Chinese Patent Application No. 201711041044.9, 22 pages. (With English Translation).
Office Action, dated Jul. 7, 2022, for Australian Patent Application No. 2019421618. (5 pages).

* cited by examiner

REFRIGERATOR AND METHOD AND DEVICE FOR CONTROLLING REFRIGERATION THEREOF

BACKGROUND

Technical Field

This application relates to the technical field of household appliances, and in particular, to a refrigerator, and a method and a device for controlling refrigeration of the refrigerator.

DESCRIPTION OF THE RELATED ART

In the related art, for a refrigerator with an ice machine, there are no requirements for a refrigeration period of a refrigerating compartment and an ice-making period of the ice machine. That is, when the ice machine is in an ice-making state, the refrigerating compartment can request and perform refrigeration at any time. This often leads to low ice-making efficiency of the ice machine, and high energy consumption of the refrigerator.

BRIEF SUMMARY

This application aims to solve one of the technical problems in the related technology at least to a certain extent.

The present disclosure in some embodiments provides a method for controlling refrigeration of a refrigerator. The method for controlling refrigeration of the refrigerator is capable of controlling the refrigeration period of the refrigerating compartment, so that the refrigeration cycle of the refrigerating compartment matches the ice-making cycle of the ice machine, thus improving the ice-making efficiency of the ice machine and reducing the energy consumption of the refrigerator.

This present disclosure in some embodiments also provides a device for controlling refrigeration of a refrigerator and the refrigerator.

To solve the above problems, a first aspect of the present disclosure provides a method for controlling refrigeration of a refrigerator. In some embodiments, a refrigeration system of the refrigerator comprises:

- a refrigerating evaporator for refrigerating a refrigerating compartment;
- an ice-making evaporator for making ice in an ice machine;
- a refrigerating capillary tube adjacent to the refrigerating evaporator and an ice-making capillary tube adjacent to the ice-making evaporator; and
- a control valve for controlling the refrigerating capillary tube and the ice-making capillary tube.

The method comprises:

- recognizing a current ice-making stage of the ice machine;
- acquiring a current temperature of an ice-making compartment in the refrigerator; and
- controlling a connecting direction of the control valve according to the current ice-making stage and the current temperature.

According to the method for controlling refrigeration of a refrigerator in embodiments of the present disclosure, the connecting direction of the control valve is controlled to determine the time for performing refrigeration and the time for ending refrigeration for corresponding compartments, thereby controlling the refrigeration period of the refrigerating compartment and delaying the refrigeration starting time of the refrigerating compartment to be within a heating-deicing stage of ice-making mode of the ice-making compartment, such that the refrigeration cycle of the refrigerating compartment matches the ice-making cycle of the ice-making compartment. As a result, the ice-making efficiency of the ice machine is improved and the energy consumption of the refrigerator is reduced.

In embodiments of the present disclosure, controlling the connecting direction of the control valve according to the current ice-making stage and the current temperature comprises:

- detecting and determining that the current ice-making stage is a heating-deicing stage;
- detecting and determining that the current temperature is greater than a first preset temperature threshold; and
- controlling the control valve to switch on the connecting direction to the refrigerating capillary tube.

In embodiments of the present disclosure, the method further comprises:

- detecting and determining that the current temperature is less than or equal to the first preset temperature threshold; and
- controlling the control valve to switch the control valve off.

In embodiments of the present disclosure, detecting and determining that the current ice-making stage is a heating-deicing stage comprises:

- acquiring a current operating power of the refrigerator;
- detecting and determining that the current operating power is within a preset range; and
- determining that the current ice-making stage is the heating-deicing stage.

In embodiments of the present disclosure, the method further comprises:

- detecting and determining that the current ice-making stage is a first ice-making stage;
- detecting and determining that the current temperature is greater than a second preset temperature threshold; and
- controlling the control valve to switch on the connecting direction to both the refrigerating capillary tube and the ice-making capillary tube.

In embodiments of the present disclosure, the method further comprises:

- detecting and determining that the current temperature is less than or equal to the second preset temperature threshold; and
- controlling the control valve to switch off the connecting direction to the refrigerating capillary tube.

In embodiments of the present disclosure, the method further comprises:

- acquiring a refrigeration request instruction issued by at least one of the refrigerating compartment and the ice-making compartment, before controlling the connecting direction of the control valve according to the current ice-making stage and the current temperature.

In embodiments of the present disclosure, the method further comprises:

- detecting and determining that the ice machine is currently operating in an ice-making mode, before recognizing a current ice-making stage of the ice machine.

In embodiments of the present disclosure, the method further comprises:

- detecting and determining that the ice machine is currently operating in a non-ice making mode;
- detecting a refrigeration request instruction issued by at least one of the refrigerating compartment and the ice-making compartment; and controlling the connecting direction of the control valve according to the refrigeration request instruction detected and a source of the refrigeration request instruction.

The present disclosure in embodiments further provides an electronic device, comprising:

at least one processor;

a memory; and at least one program, wherein the at least one program is stored in the memory that when executed by the at least one processor, to implement a method for controlling refrigeration of a refrigerator as described in embodiments of the first aspect of the present disclosure.

The present disclosure in embodiments still further provides a non-transitory computer-readable storage medium having stored therein computer programs that, when executed by a processor, causes the processor to perform a method for controlling refrigeration of a refrigerator as described in embodiments of the first aspect of the present disclosure.

To solve the above problems, a second aspect of the present disclosure provides a device for controlling refrigeration of a refrigerator. In some embodiments, a refrigeration system of the refrigerator comprises:

a refrigerating evaporator for refrigerating a refrigerating compartment; an ice-making evaporator for making ice in an ice machine;

a refrigerating capillary tube adjacent to the refrigerating evaporator and an ice-making capillary tube adjacent to the ice-making evaporator; and a control valve for controlling the refrigerating capillary tube and the ice-making capillary tube.

In some embodiments, the device comprises:

a recognizing module, configured to recognize a current ice-making stage of the ice machine;

an acquiring module, configured to acquire a current temperature of the ice-making compartment in the refrigerator; and a controlling module, configured to control a connecting direction of the control valve according to the current ice-making stage and the current temperature.

In the device for controlling refrigeration of a refrigerator according to some embodiments of the present disclosure, the connecting direction of the control valve is controlled to determine the time for performing refrigeration and the time for ending refrigeration for corresponding compartments, thereby controlling the refrigeration period of the refrigerating compartment and delaying the refrigeration starting time of the refrigerating compartment to be within a heating-deicing stage of ice-making mode of the ice-making compartment, such that the refrigeration cycle of the refrigerating compartment matches the ice-making cycle of the ice-making compartment. As a result, the ice-making efficiency of the ice machine is improved and the energy consumption of the refrigerator is reduced.

In embodiments of the present disclosure, the controlling module is further configured to:

detect and determine that the current ice-making stage is a heating-deicing stage;

detect and determine that the current temperature is greater than a first preset temperature threshold; and control the control valve to switch on the connecting direction to the refrigerating capillary tube.

In some embodiments of the present disclosure, the controlling module is further configured to:

detect and determine that the current temperature is less than or equal to the first preset temperature threshold; and control the control valve to switch the control valve off.

In some embodiments of the present disclosure, the controlling module is further configured to:

acquire a current operating power of the refrigerator;

detect and determine that the current operating power is within a preset range; and determine that the current ice-making stage is the heating-deicing stage.

In some embodiments of the present disclosure, the controlling module is further configured to:

detect and determine that the current ice-making stage is a first ice-making stage;

detect and determine that the current temperature is greater than a second preset temperature threshold; and control the control valve to switch on the connecting direction to both the refrigerating capillary tube and the ice-making capillary tube.

In some embodiments of the present disclosure, the controlling module is further configured to:

detect and determine that the current temperature is less than or equal to the second preset temperature threshold; and control the control valve to switch off the connecting direction to the refrigerating capillary tube.

In some embodiments of the present disclosure, the controlling module is further configured to:

acquire a refrigeration request instruction issued by at least one of the refrigerating compartment and the ice-making compartment.

In embodiments of the present disclosure, the controlling module is further configured to:

detect and determine that the ice machine is currently operating in an ice-making mode before recognizing a current ice-making stage of the ice machine.

In some embodiments of the present disclosure, the controlling module is further configured to:

detect and determine that the ice machine is currently operating in a non-ice making mode;

detect a refrigeration request instruction issued by at least one of the refrigerating compartment and the ice-making compartment; and control the connecting direction of the control valve according to the refrigeration request instruction detected and a source of the refrigeration request instruction.

A third aspect of the present disclosure provides a refrigerator, comprising the device for controlling refrigeration of a refrigerator, based on the device for controlling refrigeration of a refrigerator as described in embodiments of the above aspect. The device for controlling refrigeration of a refrigerator as described in embodiments of the above aspect. According to the device for controlling refrigeration of a refrigerator as described in embodiments of the above aspect, it is possible to implement the controlling of refrigeration period of the refrigerating compartment, such that the refrigeration cycle of the refrigerating compartment matches the ice-making cycle of the ice machine. As a result, the ice-making efficiency of the ice machine is improved and the energy consumption of the refrigerator is reduced.

DETAILED DESCRIPTION

Figure 1:
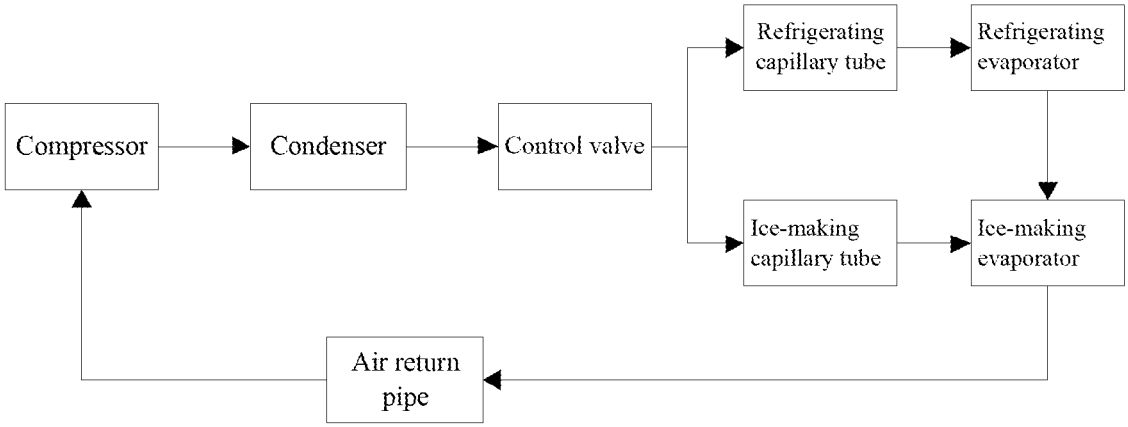
FIG. 1 is a block diagram of a refrigeration system that can be implemented in a method for controlling refrigeration of a refrigerator according to an embodiment of the present disclosure.

The embodiments of the present disclosure are described in detail below. Examples of the embodiments are shown in the accompanying drawings, in which the same or similar reference numerals indicate the same or similar elements or elements with the same or similar functions. The embodiments described below with reference to the drawings are exemplary and are intended to explain the present disclosure, which should not be understood as a limitation to the present disclosure.

A refrigerator and a method and device for controlling refrigeration of the refrigerator according to embodiments of the present disclosure are described below with reference to the drawings.

FIG. 1 is a block diagram of a refrigeration system that can be implemented in a method for controlling refrigeration of a refrigerator according to an embodiment of the present disclosure. As shown in FIG. 1, the refrigeration system includes at least a compressor, a condenser, a control valve, a refrigerating capillary tube, an ice-making capillary tube, a refrigerating evaporator, an ice-making evaporator and an air return pipe. Among them, the compressor is connected to the condenser, the condenser is connected to the control valve, the control valve is respectively connected to the refrigerating capillary tube and the ice-making capillary tube, the refrigerating capillary tube is connected to the refrigerating evaporator, the ice-making capillary tube is connected to the ice-making evaporator, the ice-making evaporator is connected to the compressor through the air return pipe, and the refrigerating evaporator is connected to the ice-making evaporator. Among them, the refrigerating evaporator is configured to refrigerate the refrigerating compartment in the refrigerator, and the ice-making evaporator is configured to make ice in the ice machine, that is, for making ice in an ice-making compartment. The control valve is configured to control switching on or switching off a connecting direction to each of the refrigerating capillary tube and the ice-making capillary tube.

Figure 2:
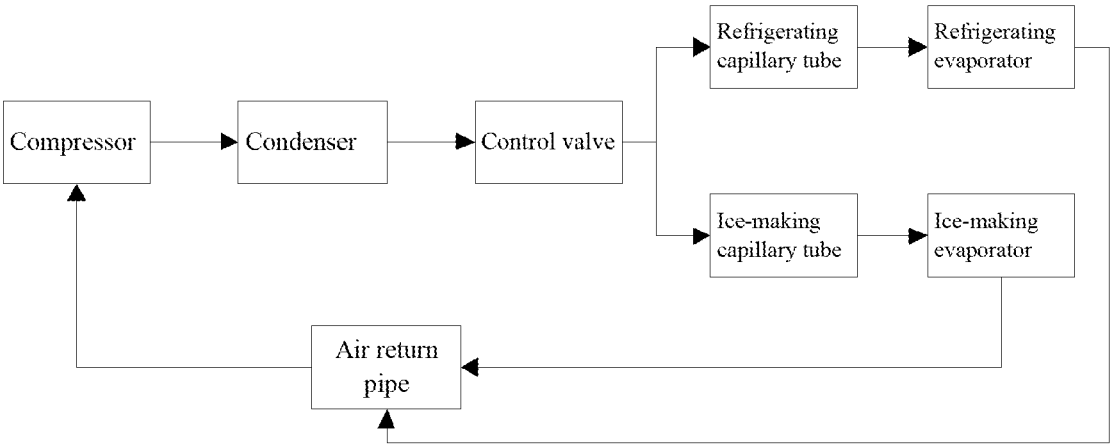
FIG. 2 is a block diagram of a refrigeration system that can be implemented in a method for controlling refrigeration of a refrigerator according to an embodiment of the present disclosure.

FIG. 2 is a block diagram of a refrigeration system that can be implemented in a method for controlling refrigeration of a refrigerator according to an embodiment of the present disclosure. As shown in FIG. 2, the refrigeration system in FIG. 2 differs from the refrigeration system in FIG. 1 in that the refrigerating evaporator in this refrigeration system is not connected to the ice-making evaporator but is connected to the compressor through the air return pipe.

It should be noted that the ice machine in the embodiments of the present disclosure can be located but not limited to, in a refrigerating compartment or a freezing compartment of the refrigerator, and the specific location can be determined according to actual conditions.

Figure 3:
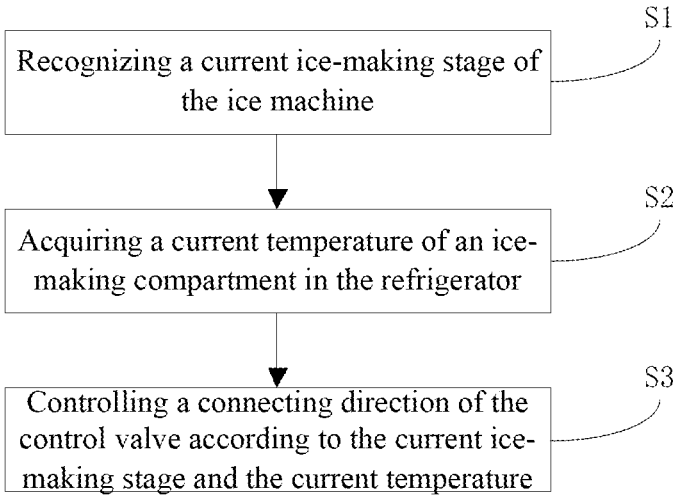
FIG. 3 is a schematic flow chart of a method for controlling refrigeration of a refrigerator according to an embodiment of the present disclosure.

FIG. 3 is a schematic flow chart of a method for controlling refrigeration of a refrigerator according to an embodiment of the present disclosure. As shown in FIG. 3, the method for controlling refrigeration of a refrigerator in this embodiment includes the following steps.

In S1, a current ice-making stage of the ice machine is recognized.

It should be noted that, in this embodiment, the ice-making stage of the ice machine includes two stages, i.e., a heating-deicing stage and a first ice-making stage. Among them, during the heating-deicing stage, a heating wire in the ice machine works to melt part of ice cubes, thereby causing the ice cubes to fall off. During the first ice-making stage, the ice-making evaporator works to decrease the temperature of the ice-making compartment, so that the liquid solidifies into a solid. It should be understood that the ice-making stage of the ice machine may be referred to as an ice-making mode, and the non-ice-making stage of the ice machine may be referred to as a non-ice-making mode to facilitate describing and distinguishing the ice-making stage and the non-ice-making stage. Optionally, it is possible to detect and determine that the ice machine is currently operating in an ice-making mode, before recognizing the current ice-making stage of the ice machine. Specifically, when detecting whether the ice machine is operating in an ice-making mode, for example, a user's interactive interface or working mode selection button may be provided on the refrigerator, so that whether the ice machine is currently operating in an ice-making mode can be determined by user according to the user's interactive interface or working mode selection button on the refrigerator. If the user selects the ice-making mode through the user's interactive interface, it is determined that the ice machine is currently operating in an ice-making mode. Optionally, the working mode can be selected through voice or remote control. When the ice-making mode is selected through voice or remote control, it can be determined that the ice machine is currently operating in an ice-making mode.

During the heating-deicing stage in the ice-making mode, the heating wire in the ice machine needs to work to increase the temperature, to cause the solidified ice cubes to fall off.

Thus, the current operating power of the refrigerator would be greater than the normal operating power of the refrigerator under the action of heating wire. Thereby, in embodiments of the present disclosure, the current ice-making stage in the ice-making mode can be determined according to the current operating power of the refrigerator.

Figure 4:
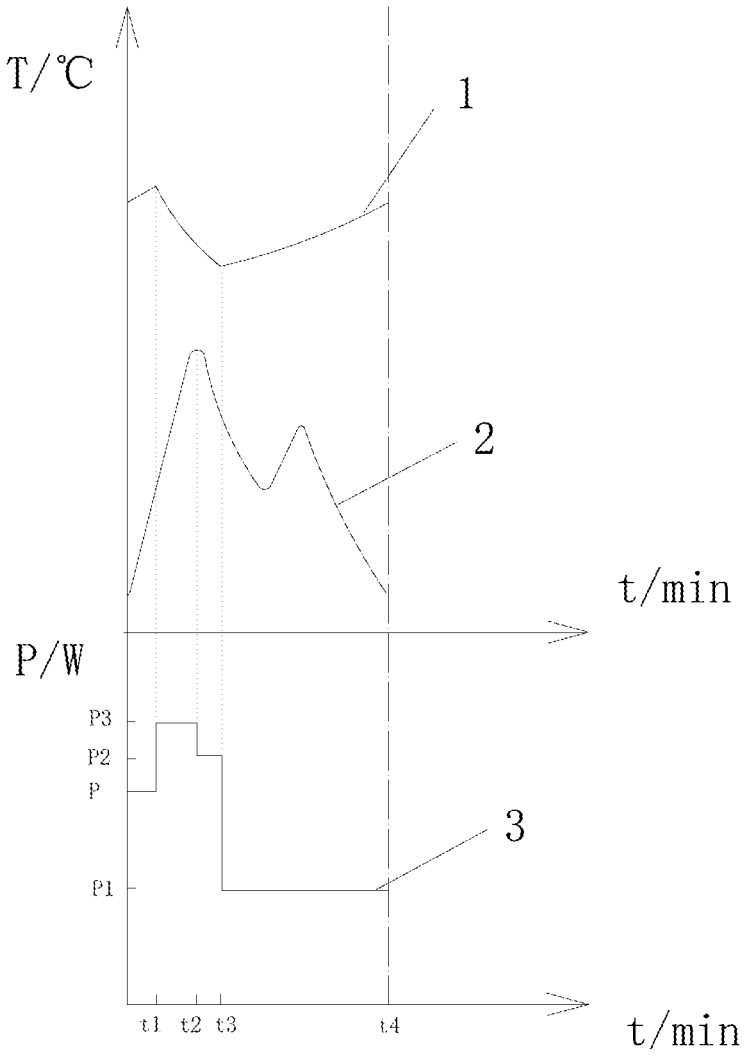
FIG. 4 is a schematic diagram showing a refrigeration cycle of a refrigerating compartment and an ice-making cycle of an ice-making compartment in a method for controlling refrigeration of a refrigerator according to an embodiment of the present disclosure.

In the actual working process of the refrigerator, the operating power during the heating-deicing stage (hereinafter referred to as the "first power") is greater than the refrigerating power of the ice-making compartment alone in the refrigerator, but is less than the refrigerating power of both the ice-making compartment and the refrigerating compartment in the refrigerator (hereinafter referred to as the "second power"). Thus, during the heating-deicing stage, when the refrigerator simultaneously performs the refrigeration of refrigerating compartment, the operating power of the refrigerator (hereinafter referred to as the "third power" for convenience of description) would be greater than the second power due to the large power of heating wire in the ice machine. As shown in FIG. 4, line 1 shows the change of temperature in the refrigerating compartment with time, line 2 shows the change of temperature in the ice-making compartment with time, and line 3 shows the change of operating power of the refrigerator with time. Among them, in the time period from 0 to t1, the refrigerating compartment does not perform refrigeration but the ice-making mode is in the heating-deicing stage; in the time period from t1 to t2, the refrigerating compartment performs refrigeration and the ice-making mode is in the heating-deicing stage; in the time period from t2 to t3, the refrigerating compartment continues refrigeration but the ice-making mode turns to an ice-making stage; and in the time period from t3 to t4, the refrigerating compartment stops refrigeration and the ice-making mode keeps in the ice-making stage until the ice-making stage ends. In the entire ice-making mode, the operating power P during the heating-deicing stage is within the range of the first power P1 to the second power P2. Thus, whether the ice-making mode is in the heating-deicing stage can be determined according to the operating power of the refrigerator. If the ice-making mode is not in the heating-deicing stage, it is in a first ice-making stage.

Optionally, after the ice machine is determined to be operated in the ice-making mode, a current temperature of the heating wire in the ice machine can be detected, thereby determining the current temperature of the heating wire. If the current temperature of the heating wire is higher than the preset temperature, it indicates that the ice machine is currently in the heating-deicing stage of the ice-making mode.

In S2, a current temperature of an ice-making compartment in the refrigerator is acquired.

Specifically, a temperature sensor may be provided in the ice-making compartment in the refrigerator to detect the current temperature of the ice-making compartment.

In S3, a connecting direction of the control valve is controlled according to the current ice-making stage and the current temperature.

According to the current ice-making stage of the ice-making mode and the current temperature in the ice-making compartment acquired, the connecting direction of the control valve can be controlled to determine whether the refrigerating compartment is to be refrigerated. Through controlling the refrigeration period of the refrigerating compartment, the refrigeration cycle of the refrigerating compartment can match the ice-making cycle of the ice-making compartment, thus reducing the influence of the refrigeration in the refrigerating compartment on the ice-making in the ice machine, improving the ice-making efficiency and ice-making amount, shortening the ice-making cycle, and reducing the energy consumption of the refrigerator.

Figure 5:
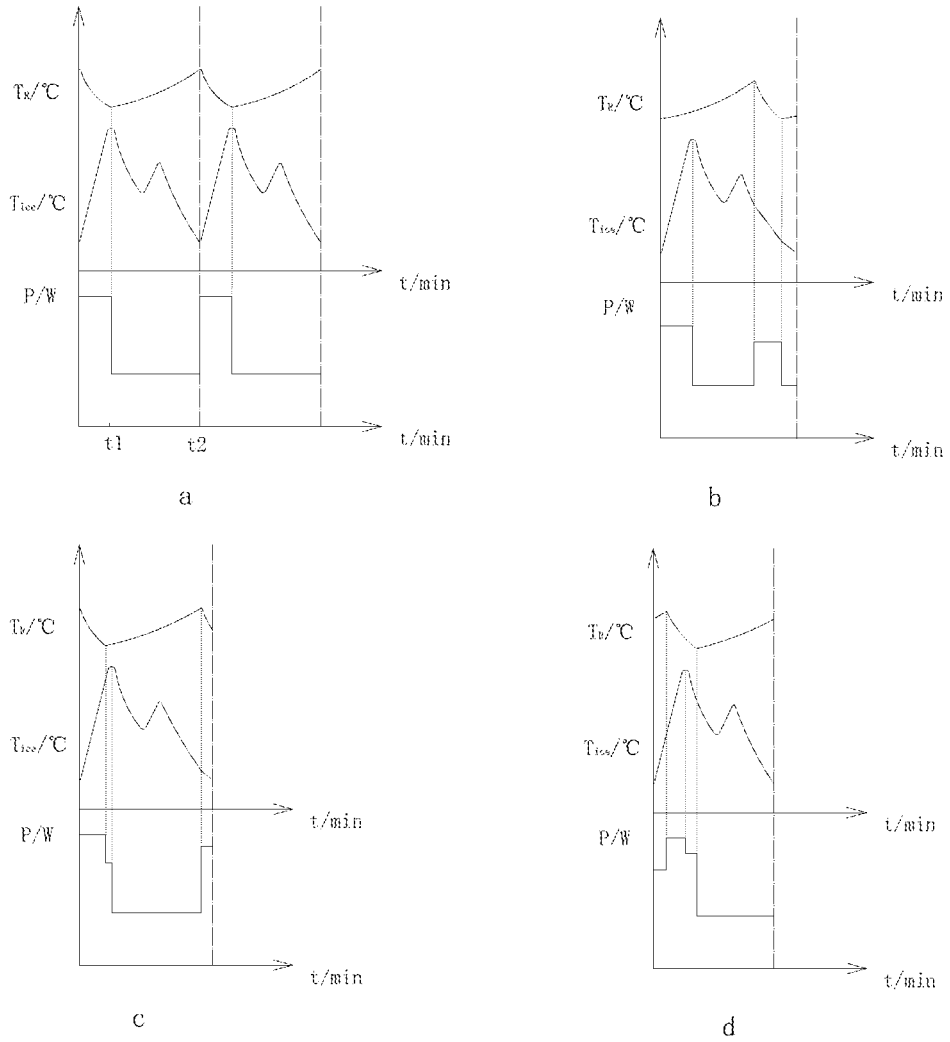
FIG. 5 is a schematic diagram of comparison of a refrigeration cycle of a refrigerating compartment and an ice-making cycle of an ice-making compartment in a method for controlling refrigeration of a refrigerator according to an embodiment of the present disclosure.

Referring to FIG. 5, it should be noted that, in an ideal state, as shown in FIG. 5*a*, the refrigeration cycle of the refrigerating compartment is the same as the refrigeration cycle of the ice-making compartment. In this state, the ice-making efficiency of the ice machine is the highest, the ice-making amount is the largest and the energy consumption of the refrigerator is the lowest. Among them, during the time period from 0 to t1, the refrigerating compartment is in a refrigeration stage and the ice-making compartment is in a heating-deicing stage; during the time period from t1 to t2, the refrigerating compartment ends refrigerating, while the ice-making compartment starts into the first ice-making stage, and ice making begins. However, in practice, since the refrigeration cycle of the refrigerating compartment is often shorter than the ice-making cycle of the ice-making compartment, the situation shown in FIG. 5*b* often occurs during the operation of the refrigerator, thereby generally resulting in the refrigerating compartment being in a refrigeration stage and the ice-making compartment being in a first ice-making stage. In this case, due to the splitting of the refrigerant, the temperature of the ice-making evaporator rises, despite still lower than the preset temperature, resulting in slow down of the decrease of temperature of the ice-making compartment, decreasing the ice-making rate, increasing the ice-making cycle, reducing the ice-making amount and increasing the energy consumption. In addition, even when the refrigeration starting time of the refrigerating compartment keeps path with the heating-deicing time of the ice-making compartment, the situation shown in FIG. 5*c* occurs. In this case, the ice-making compartment is still in the late stage of the heating-deicing stage when the refrigerating compartment begins a refrigeration stage again. Meanwhile, due to the splitting of the refrigerant, the temperature of the ice-making evaporator rises, despite still lower than the preset temperature, which would slow down the decrease of temperature of the ice-making compartment, decrease the ice-making rate, increase the ice-making cycle, reduce the ice-making amount, and increase the energy consumption. However, in the embodiments of the present disclosure, through controlling the refrigeration period of the refrigerating compartment and delaying the refrigeration starting time of the refrigerating compartment to be within a heating-deicing stage of ice-making mode of the ice-making compartment, the refrigeration cycle of the refrigerating compartment can match the ice-making cycle of the ice-making compartment, thereby forming the cycles as shown in FIG. 5*d*, thus greatly reducing the time period when both the refrigerating compartment and the ice-making compartment perform refrigerating. As a result, the influence of refrigeration in the refrigerating compartment on ice-making in the ice-making compartment is reduced, the ice-making efficiency and ice-making amount are improved, the ice-making cycle is shortened, and the energy consumption of the refrigerator is reduced.

Above all, the present disclosure in embodiments provides a method for controlling refrigeration of a refrigerator. The method controls the connecting direction of the control valve in the refrigeration system of the refrigerator according to the current ice-making stage of the ice machine and the current temperature of the ice-making compartment. Through controlling the connecting direction of the control valve to determine the time of performing refrigeration and the time of ending refrigeration for corresponding compartments, the refrigeration period of the refrigerating compartment is controlled and the refrigeration starting time of the refrigerating compartment is delayed to be within a heating-deicing stage of ice-making mode of the ice-making compartment, such that the refrigeration cycle of the refrigerating compartment matches the ice-making cycle of the ice-making compartment. As a result, the ice-making efficiency of the ice machine and the ice-making amount is improved, the ice-making cycle is shortened, and the energy consumption of the refrigerator is reduced.

Figure 6:
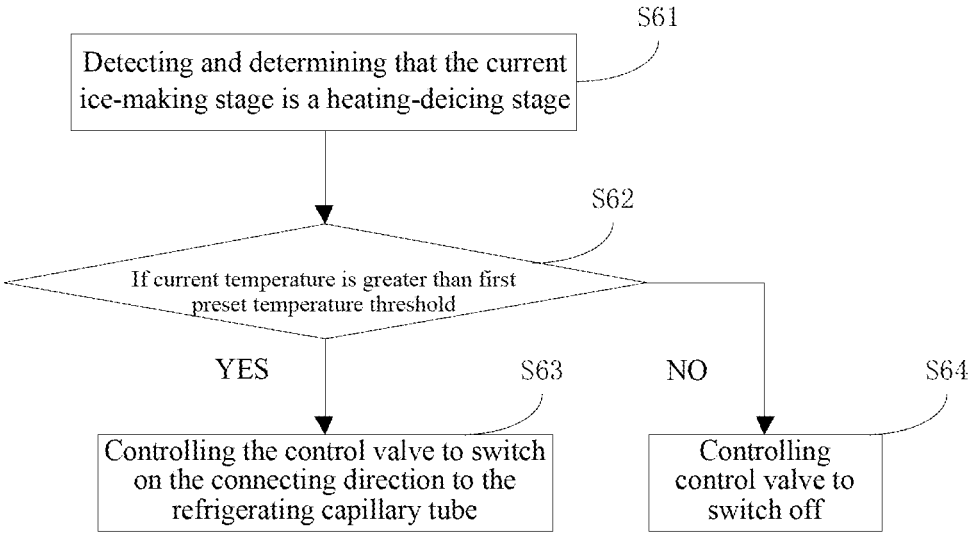
FIG. 6 is a schematic flow chart of a process for controlling a refrigeration starting time of a refrigerating compartment in a method for controlling refrigeration of a refrigerator according to an embodiment of the present disclosure.

In some embodiments, the time for performing refrigeration in the refrigerating compartment can be determined according to the temperature in the ice-making compartment. FIG. 6 is a schematic flow chart of a process for controlling a refrigeration starting time of the refrigerating compartment in the method for controlling refrigeration of a refrigerator according to an embodiment of the present disclosure. As shown in FIG. 6, the method includes the following steps:

In S61, whether the current ice-making stage is a heating-deicing stage is detected and determined.

Specifically, whether the refrigerator is in the heating-deicing stage can be determined according to the current operating power of the refrigerator. Referring to the description in step S1, if the current operating power of the refrigerator is between the first power and the second power, it indicates that the current ice-making stage is a heating-deicing stage.

In S62, whether the current temperature is greater than a first preset temperature threshold is detected and determined.

It should be noted that the first preset temperature threshold is preset in the refrigerator, and whether the refrigeration in the refrigerating compartment is initiated can be determined according to the temperature in the ice-making compartment and the first preset temperature threshold. In embodiments of the present disclosure, the first preset temperature threshold is set, and only when the temperature in the ice-making compartment is greater than the first preset temperature threshold, the refrigeration in the refrigerating compartment can be initiated. This allows delaying the refrigeration starting time of the refrigerating compartment, such that the refrigeration cycle of the refrigerating compartment can match the ice-making cycle of the ice-making compartment.

Specifically, the current temperature of the refrigerating compartment of the refrigerator is acquired and then compared with the first preset temperature threshold. Further, the magnitude relationship between the current temperature of the refrigerating compartment of the refrigerator and the first preset temperature threshold is determined. If the current temperature is greater than the first preset temperature threshold, step S63 is executed; otherwise, step S64 is executed.

In S63, the control valve is controlled to switch on the connecting direction to the refrigerating capillary tube.

Specifically, when the current temperature is greater than the first preset temperature threshold, the refrigeration of the refrigerating compartment is performed, that is, controlling the control valve to switch on the connecting direction to the refrigerating capillary tube. It should be understood that the control valve switches off the connecting direction to the ice-making capillary tube at this time.

In S64, the control valve is controlled to be switched off.

Specifically, if the current temperature is less than or equal to the first preset temperature threshold, the control valve switches off, that is, the refrigeration system stops refrigerating, thereby delaying the refrigeration starting time of the refrigerating compartment.

Figure 7:
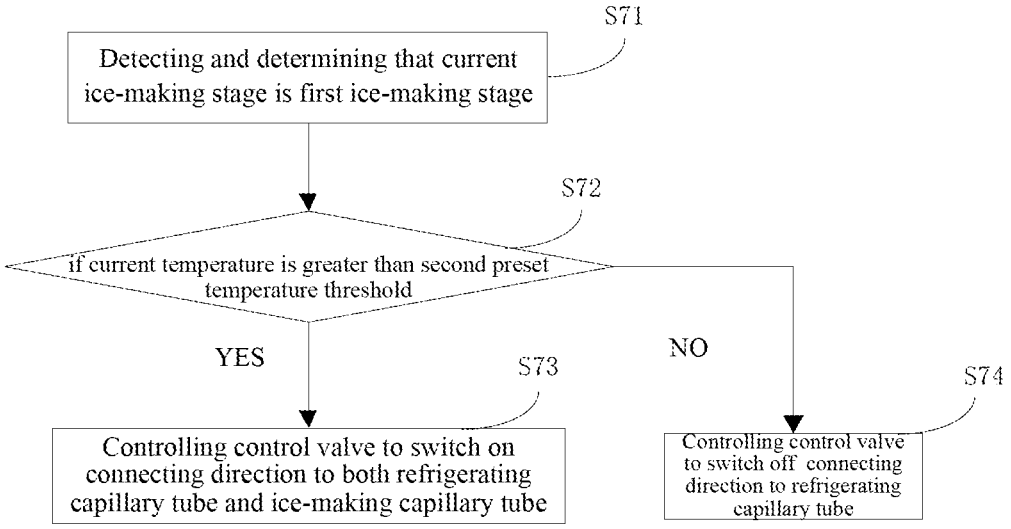
FIG. 7 is a schematic flow chart of a process for improving ice-making efficiency in a method for controlling refrigeration of a refrigerator according to an embodiment of the present disclosure.

In some embodiments, considering that the simultaneous refrigeration of the refrigerating compartment and the refrigerating compartment for a long time would reduce the ice-making efficiency and increase the energy consumption, the refrigeration ending time of the refrigerating compartment can also be controlled to avoid occurrence of the above situation. Specifically, referring to FIG. 7, FIG. 7 is a schematic flow chart of a process for improving ice-making efficiency in the method for controlling refrigeration of a refrigerator according to an embodiment of the present disclosure. As shown in FIG. 7, the method includes the following steps.

In S71, whether the current ice-making stage is a first ice-making stage is detected and determined.

Specifically, whether the heating-deicing stage ends can be detected. When the heating-deicing stage ends, it indicates that the current ice-making stage is in the first ice-making stage.

In S72, whether the current temperature is greater than a second preset temperature threshold is detected and determined.

It should be noted that the second preset temperature threshold is preset in the refrigerator. Whether the refrigeration in the refrigerating compartment ends can be determined according to the temperature in the ice-making compartment and the second preset temperature threshold. The setting of the second preset temperature threshold prevents the refrigerating compartment and the ice-making compartment from simultaneously refrigerating for a long time, thus not only reducing energy consumption and improving ice-making efficiency, but also meeting the refrigeration requirements of the refrigerating compartment. For example, if the target temperature set in the refrigerating compartment is lower than the second preset temperature threshold, the refrigeration of the refrigerating compartment is ended in advance to ensure ice-making efficiency; and if the target temperature set in the refrigerating compartment is greater than or equal to the second preset temperature threshold, the refrigeration of the refrigerating compartment can be ended when the target temperature is reached.

Specifically, the current temperature of the refrigerating compartment of the refrigerator is acquired and then compared with the second preset temperature threshold. Further, the magnitude relationship between the current temperature of the refrigerating compartment of the refrigerator and the second preset temperature threshold is determined. If the current temperature is greater than the second preset temperature threshold, step S73 is executed; otherwise, step S74 is executed.

In S73, the control valve is controlled to switch on the connecting direction to both the refrigerating capillary tube and the ice-making capillary tube.

Specifically, if the current temperature is greater than the second preset temperature threshold, the control valve is controlled to switch on the connecting direction to both the refrigerating capillary tube and the ice-making capillary tube, thus performing the refrigeration in both the ice-making compartment and the refrigerating compartment.

In S74, the control valve is controlled to switch off the connecting direction to the refrigerating capillary tube.

Specifically, if the current temperature is less than or equal to the second preset temperature threshold, the control valve is controlled to switch off the connecting direction to the refrigerating capillary tube, thus ending the refrigeration in the refrigerating compartment.

It should be understood that, in this embodiment, the method needs to acquire a refrigeration request instruction issued by at least one of the refrigerating compartment and the ice-making compartment before controlling the connecting direction of the control valve, and select the connecting direction to be switched on by the control valve according to the corresponding refrigeration request instruction.

Figure 8:
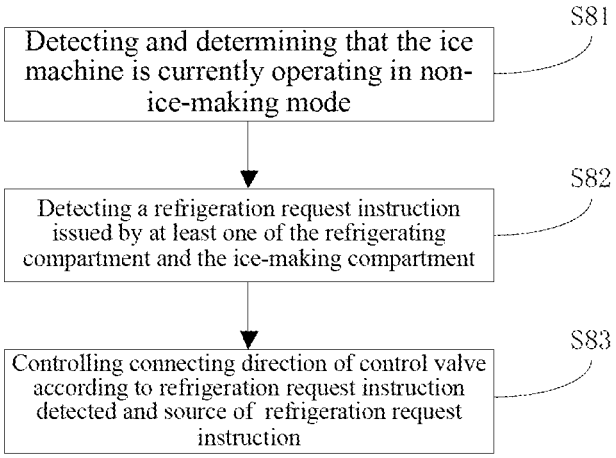
FIG. 8 is a schematic flow chart of a method for controlling refrigeration of a refrigerator according to an embodiment of the present disclosure.

In some embodiments, if the ice machine is currently operating in a non-ice-making mode, the connecting direction of the control valve can be controlled according to the following steps. As shown in FIG. 8, the method includes the following steps.

In S81, whether the ice machine is currently operating in a non-ice-making mode is detected and determined.

Specifically, referring to the description in step S1 as described above, if the ice machine is not in the ice-making mode, it is determined that the ice machine is currently operating in a non-ice-making mode.

In S82, whether a refrigeration request instruction issued by at least one of the refrigerating compartment and the ice-making compartment is detected.

Specifically, during the operation of the refrigerator, when the internal temperature of the refrigerator changes, compartments like the refrigerating compartment, the ice-making compartment and the like are to be refrigerated from time to time. When a corresponding compartment needs to be refrigerated, the corresponding compartment will issue a refrigeration request instruction to request the refrigeration by the refrigerator.

Thus, the refrigeration request instruction issued by respective compartment can be detected in real time or at intervals.

In S83, the connecting direction of the control valve is controlled according to the refrigeration request instruction detected and a source of the refrigeration request instruction.

Specifically, the connecting direction of the control valve is controlled according to the refrigeration request instruction issued by corresponding compartments. For example, if the ice-making compartment and the refrigerating compartment both issue a refrigeration request instruction, the control valve would switch on the connecting direction to both the refrigerating capillary tube and the ice-making capillary tube. If the ice-making compartment issues a refrigeration request instruction but the refrigerating compartment does not issue a refrigeration request instruction, the control valve would switch on the connecting direction to the ice-making capillary tube but would switch off the connecting direction to the refrigerating capillary tube.

Figure 9:
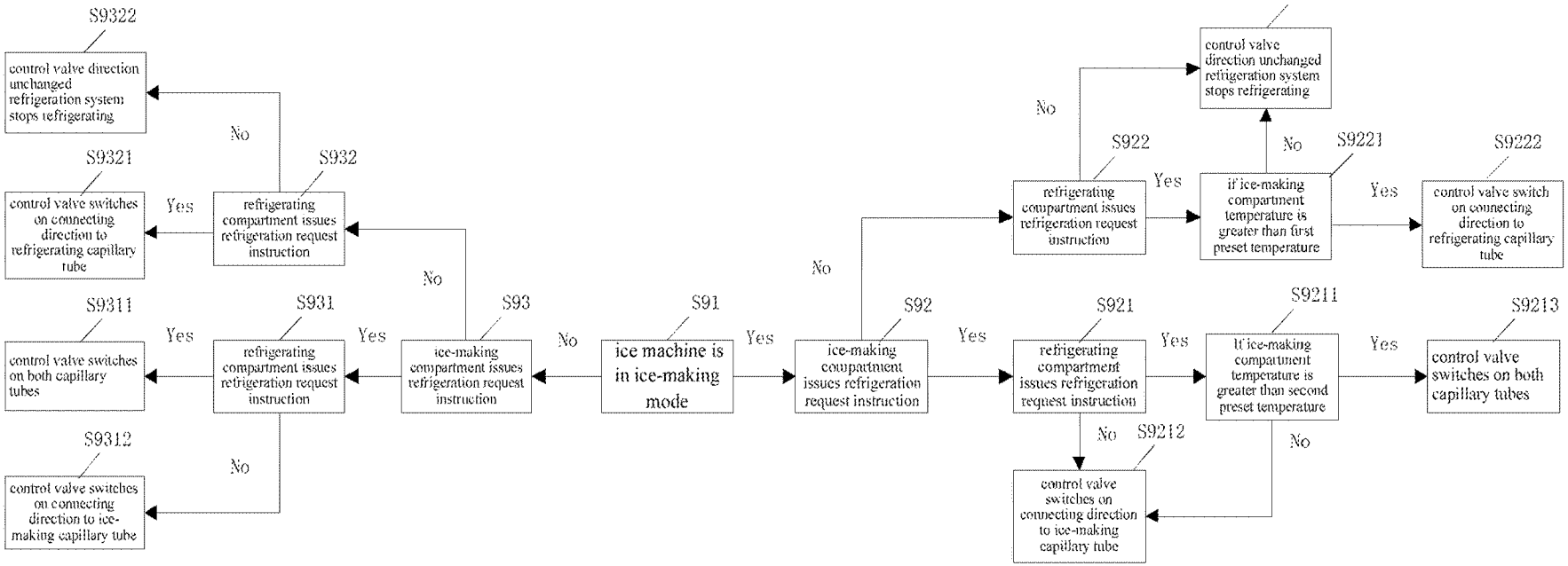
FIG. 9 is a flow chart of a process for controlling a method for controlling refrigeration of a refrigerator according to an embodiment of the present disclosure.

FIG. 9 is a flow chart of a process for controlling the method for controlling refrigeration of a refrigerator according to an embodiment of the present disclosure. As shown in FIG. 9, the process for controlling the method for controlling refrigeration of a refrigerator according to an embodiment of the present disclosure includes the following steps.

In S91, whether the ice machine is in an ice-making mode is detected.

If yes, a step S92 is executed. If no, a step S93 is executed.

In S92, whether the ice-making compartment issues a refrigeration request instruction is detected.

If yes, a step S921 is executed. If no, a step S922 is executed.

In S921, whether the refrigerating compartment issues a refrigeration request instruction is detected.

If yes, a step S8211 is executed. If no, a step S9212 is executed.

In S9211, whether the current temperature of the ice-making compartment is greater than a second preset temperature threshold is detected.

If yes, a step S9213 is executed. If no, a step S9212 is executed.

In S9212, the control valve switches on the connecting direction to the ice-making capillary tube.

In S9213, the control valve switches on the connecting direction to both the refrigerating capillary tube and the ice-making capillary tube.

In S922, whether the refrigerating compartment issues a refrigeration request instruction is detected.

If yes, a step S9221 is executed. If no, a step S9222 is executed.

In S9221, whether the current temperature of the ice-making compartment is greater than a first preset temperature threshold is detected.

If yes, a step S9222 is executed. If no, a step S9223 is executed.

In S9222, the control valve switches on the connecting direction to the refrigerating capillary tube.

In S9223, the connecting direction of the control valve remains unchanged and the refrigeration system stops refrigerating.

In S93, whether the ice-making compartment issues a refrigeration request instruction is detected.

If yes, a step S931 is executed. If no, a step S932 is executed.

In S931, whether the refrigerating compartment issues a refrigeration request instruction is detected.

If yes, a step S9311 is executed. If no, a step S9312 is executed.

In S9311, the control valve switches on the connecting direction to both the refrigerating capillary tube and the ice-making capillary tube.

In S9312, the control valve switches on the connecting direction to the ice-making capillary tube.

In S932, whether the refrigerating compartment issues a refrigeration request instruction is detected.

If yes, a step S9321 is executed. If no, a step S9322 is executed.

In S9321, the control valve switches on the connecting direction to the refrigerating capillary tube.

In S9322, the connecting direction of the control valve remains unchanged and the refrigeration system stops refrigerating.

It should be noted that, according to the method provided in this embodiment, the refrigeration system of the refrigerator is controlled, such that the refrigeration cycle of the refrigerating compartment matches the ice-making cycle of the ice-making compartment, as shown in the schematic diagram of the refrigeration cycle of refrigerating compartment and the ice-making cycle of ice-making compartment in FIG. 4. Therefore, the ice-making in the ice machine is less influenced by the refrigeration in the refrigerating compartment, thus improving the ice-making efficiency and ice-making amount, shortening the ice-making cycle, and reducing the energy consumption of the refrigerator.

To implement the method in the foregoing embodiments, the present disclosure still further provides a device for controlling refrigeration of a refrigerator, in which a refrigeration system of the refrigerator includes:

- a refrigerating evaporator for refrigerating a refrigerating compartment;
- an ice-making evaporator for making ice in an ice machine;

a refrigerating capillary tube adjacent to the refrigerating evaporator and an ice-making capillary tube adjacent to the ice-making evaporator; and a control valve for controlling the refrigerating capillary tube and the ice-making capillary tube.

Figure 10:
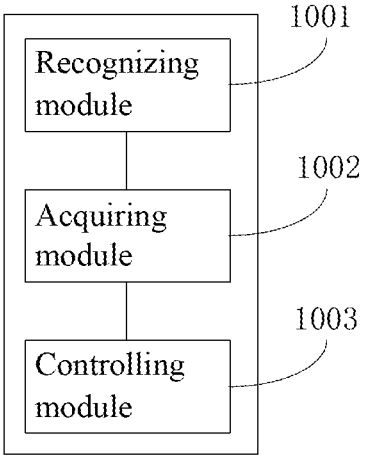
FIG. 10 is a block diagram showing the structure of a device for controlling refrigeration of a refrigerator according to an embodiment of the present disclosure.

FIG. 10 is a block diagram showing the structure of a device for controlling refrigeration of a refrigerator according to an embodiment of the present disclosure. As shown in FIG. 10, the device includes:

a recognizing module 1001, configured to recognize a current ice-making stage of the ice machine;

an acquiring module 1002, configured to acquire a current temperature of the ice-making compartment in the refrigerator; and a controlling module 1003, configured to control a connecting direction of the control valve according to the current ice-making stage and the current temperature.

Further, the controlling module 1003 is further configured to:

detect and determine that the current ice-making stage is a heating-deicing stage;

detect and determine that the current temperature is greater than a first preset temperature threshold; and control the control valve to switch on the connecting direction to the refrigerating capillary tube.

Further, the controlling module 1003 is further configured to:

detect and determine that the current temperature is less than or equal to the first preset temperature threshold; and control the control valve to be in a switch off position.

Further, the controlling module 1003 is further configured to:

acquire a current operating power of the refrigerator;

detect and determine that the current operating power is within a preset range; and determine that the current ice-making stage is the heating-deicing stage.

Further, the controlling module 1003 is further configured to:

detect and determine that the current ice-making stage is a first ice-making stage;

detect and determine that the current temperature is greater than a second preset temperature threshold; and control the control valve to switch on the connecting direction to both the refrigerating capillary tube and the ice-making capillary tube.

Further, the controlling module 1003 is further configured to:

detect and determine that the current temperature is less than or equal to the second preset temperature threshold; and control the control valve to switch off the connecting direction to the refrigerating capillary tube.

Further, the controlling module 1003 is further configured to:

acquire a refrigeration request instruction issued by at least one of the refrigerating compartment and the ice-making compartment.

Further, the controlling module 1003 is further configured to:

detect and determine that the ice machine is currently operating in an ice-making mode before recognizing the current ice-making stage of the ice machine.

Further, the controlling module 1003 is further configured to:

detect and determine that the ice machine is currently operating in a non-ice making mode;

detect a refrigeration request instruction issued by at least one of the refrigerating compartment and the ice-making compartment; and control the connecting direction of the control valve according to the refrigeration request instruction detected and a source of the refrigeration request instruction.

It should be understood that the foregoing device is configured to execute the method described in the foregoing embodiments. The corresponding program module in the device has implementation principles and technical effects which are similar to those described in the foregoing method. The working process of the device may take reference to the process of the corresponding method as above, which will not be repeated herein.

According to the device for controlling refrigeration of a refrigerator provided in the embodiments of the present disclosure, the controlling module in the device controls a connecting direction of the control valve in the refrigeration system of the refrigerator according to the current ice-making stage of the ice machine recognized by the recognizing module and the current temperature of the ice-making compartment acquired by the acquiring module. Therefore, the connecting direction of the control valve is controlled to determine the time for performing refrigeration and the time for ending refrigeration for corresponding compartments, thereby controlling the refrigeration period of the refrigerating compartment and delaying the refrigeration starting time of the refrigerating compartment to be within a heating-deicing stage of ice-making mode of the ice-making compartment, such that the refrigeration cycle of the refrigerating compartment matches the ice-making cycle of the ice-making compartment. As a result, the ice-making efficiency of the ice machine and ice-making amount are improved, the ice-making cycle is shortened, and the energy consumption of the refrigerator is reduced.

Figure 11:
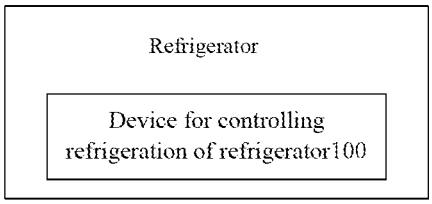
FIG. 11 is a block diagram showing the structure of a refrigerator according to an embodiment of the present disclosure.

To implement the above embodiments, the present disclosure still further provides a refrigerator. FIG. 11 is a block diagram showing the structure of a refrigerator according to an embodiment of the present disclosure. As shown in FIG. 11, the refrigerator includes the device for controlling refrigeration of the refrigerator 100.

Figure 12:
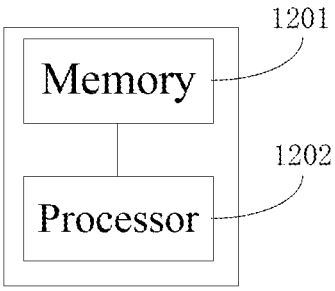
FIG. 12 is a block diagram showing the structure of an electronic device according to an embodiment of the present disclosure.

To implement the above embodiments, the present disclosure still further provides an electronic device. FIG. 12 is a block diagram showing the structure of an electronic device according to an embodiment of the present disclosure. As shown in FIG. 12, the electronic device includes a memory 1201 and a processor 1202. The processor 1202 runs a program corresponding to an executable program code by reading the executable program code stored in the memory 1201, to be configured to implement each step in the method described above.

To implement the embodiments as mentioned above, the present disclosure still further provides a non-transitory computer-readable storage medium having stored therein computer programs that, when executed by a processor, causes the processor to implement each step in the method described above.

In the description of the present disclosure, it should be understood that the terms "center", "longitudinal", "transverse", "length", "width", "thickness", "upper", "lower", "front", "back", "left", "right", "vertical", "horizontal", "top", "bottom", "inner", "outer", "clockwise", "counter-clockwise", "axial", "radial", "circumferential" and the like indicate the orientation or positional relationship is that shown in the drawings, and is only for the convenience of describing the present disclosure and simplifying the description, rather than indicating or implying the pointed device or element has to have a specific orientation, and be constructed and operated in a specific orientation, and therefore cannot be understood as a limitation of the present disclosure.

In addition, the terms "first" and "second" are only used for descriptive purposes and cannot be understood as indicating or implying relative importance or implicitly indicating the number of indicated technical features. Therefore, the features defined with "first" and "second" may explicitly or implicitly include at least one of the features. In the description of the present disclosure, the "plurality" means two or more than two, unless otherwise specifically defined.

In the present disclosure, the terms "disposed", "arranged", "connected", "fixed" and the like should be understood broadly and may be either a fixed connection or a detachable connection, or an integration; may be a mechanical connection, or an electrical connection; may be directly connected, or connected via an intermediate medium; and may be the internal communication of two elements or the interaction of two elements, unless otherwise explicitly stated and defined. For those skilled in the art, the specific meanings of the above terms in the present disclosure can be understood according to specific situations.

In the present disclosure, a first feature "on" or "under" a second feature may refer to a direct contact of the first feature with the second feature or an indirect contact of the first feature and the second feature via an intermediate medium, unless otherwise explicitly stated and defined. Moreover, a first feature "above" a second feature may mean the first feature is right above or obliquely above the second feature, or merely that the first feature is located at a level higher than the second feature. A first feature "below" a second feature may mean the first feature is just below or obliquely below the second feature, or merely that the first feature is located at a level lower than the second feature.

Reference throughout this specification to "an embodiment", "one embodiment", "some embodiments", "an example", "a specific example" or "some examples" means that a particular feature, structure, material, or characteristic described in connection with the embodiment or example is included in at least one embodiment or example of the present disclosure. Thus, the appearances of the phrases such as "in some embodiments", "in one embodiment", "in an embodiment", "in an example", "in a specific example" or "in some examples" in various places throughout this specification are not necessarily referring to the same embodiment or example of the present disclosure. Moreover, the described particular feature, structure, material, or characteristic may be combined in any one or more embodiments or examples in a suitable manner. Furthermore, the different embodiments or examples and the features of the different embodiments or examples described in this specification may be combined by those skilled in the art without contradiction.

Although embodiments of the present disclosure have been shown and described in the above, it would be appreciated that the above embodiments are exemplary which cannot be construed to limit the present disclosure, and changes, alternatives, substitution and modifications can be made in the embodiments by those skilled in the art without departing from scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A method for controlling refrigeration of a refrigerator using a refrigeration system, wherein the refrigeration system comprises:

a refrigerating evaporator for refrigerating a refrigerating compartment, an ice-making evaporator for making ice in an ice machine, a refrigerating capillary tube adjacent to the refrigerating evaporator and an ice-making capillary tube adjacent to the ice-making evaporator, and a control valve for controlling the refrigerating capillary tube and the ice-making capillary tube; and wherein the method is implemented using an electronic device, the electronic device comprising:

a memory, and a processor configured to run a program corresponding to an executable program code by reading the executable program code stored in the memory, the method comprising:

recognizing a current ice-making stage of the ice machine;

acquiring a current temperature of an ice-making compartment in the ice machine; and controlling a connecting direction of the control valve according to the current ice-making stage and the current temperature.

2. The method according to claim 1, wherein controlling the connecting direction of the control valve according to the current ice-making stage and the current temperature comprises:

determining that the current ice-making stage is a heating-deicing stage;

determining whether the current temperature is greater than a first preset temperature threshold; and controlling the connecting direction of the control valve such that the control valve is connected to the refrigerating capillary tube in response the current temperature being greater than the first preset temperature threshold.

3. The method according to claim 2, further comprising:

in response to the current temperature being no greater than the first preset temperature threshold, controlling the connection direction of the control valve such that the connection between the control valve and the refrigerating capillary tube is switched off.

4. The method according to claim 2, wherein determining that the current ice-making stage is a heating-deicing stage comprises:

acquiring a current operating power of the refrigerator;

determining that the current operating power is within a preset range; and determining that the current ice-making stage is the heating-deicing stage.

5. The method according to claim 1, further comprising:

determining that the current ice-making stage is a first ice-making stage;

determining whether the current temperature is greater than a second preset temperature threshold; and controlling the connecting direction of the control valve such that the control valve is connected to both the refrigerating capillary tube and the ice-making capillary tube in response to the current temperature being greater than the second preset temperature threshold.

6. The method according to claim 5, further comprising:

in response to the current temperature being no greater than the second preset temperature threshold, controlling the connecting direction of the control valve such that connection between the control valve and the refrigerating capillary tube is switched off.

7. The method according to claim 1, further comprising:

acquiring a refrigeration request instruction issued by at least one of the refrigerating compartment and the ice-making compartment, before controlling the connecting direction of the control valve according to the current ice-making stage and the current temperature.

8. The method according to claim 1, further comprising:

determining that the ice machine is currently operating in an ice-making mode, before recognizing the ice machine being in the current ice-making stage.

9. The method according to claim 1, further comprising:

determining that the ice machine is currently operating in a non-ice making mode;

detecting a refrigeration request instruction issued by at least one of the refrigerating compartment and the ice-making compartment; and controlling the connecting direction of the control valve according to the refrigeration request instruction detected and a source of the refrigeration request instruction.

10. A device for controlling refrigeration of a refrigerator using a refrigeration system, comprising:

a recognizing module configured to recognize a current ice-making stage of an ice machine in the refrigerator;

an acquiring module configured to acquire a current temperature of an ice-making compartment in the ice machine; and a controlling module, configured to control a connecting direction of a control valve according to the current ice-making stage and the current temperature, wherein the refrigeration system comprises:

a refrigerating evaporator for refrigerating a refrigerating compartment, an ice-making evaporator for making ice in the ice machine, a refrigerating capillary tube adjacent to the refrigerating evaporator and an ice-making capillary tube adjacent to the ice-making evaporator, and the control valve for controlling the refrigerating capillary tube and the ice-making capillary tube.

11. The device according to claim 10, wherein the controlling module is further configured to:

determine that the current ice-making stage is a heating-deicing stage;

determine whether the current temperature is greater than a first preset temperature threshold; and control the connecting direction of the control valve such that the control valve is connected to the refrigerating capillary tube in response to the current temperature being greater than the first preset temperature threshold.

12. The device according to claim 11, wherein the controlling module is further configured to:

in response to the current temperature being no greater than the first preset temperature threshold, control the connecting direction of the control valve such that the connection between the control valve and the refrigerating capillary tube is switched off.

13. The device according to claim 11, wherein the controlling module is further configured to:

acquire a current operating power of the refrigerator;

determine that the current operating power is within a preset range; and determine that the current ice-making stage is the heating-deicing stage.

14. The device according to claim 10, wherein the controlling module is further configured to:

determine that the current ice-making stage is a first ice-making stage;

determine whether the current temperature is greater than a second preset temperature threshold; and control the connecting direction of the control valve such that the control valve is connected to both the refrigerating capillary tube and the ice-making capillary tube in response to the current temperature being greater than the second preset temperature threshold.

15. The device according to claim 14, wherein the controlling module is further configured to:

in response to the current temperature being no greater than the second preset temperature threshold, control the connecting direction of the control valve such that the connection between the control valve and the refrigerating capillary tube is switched off.

16. The device according to claim 10, wherein the controlling module is further configured to:

acquire a refrigeration request instruction issued by at least one of the refrigerating compartment and the ice-making compartment.

17. The device according to claim 10, wherein the controlling module is further configured to:

determine that the ice machine is currently operating in an ice-making mode before recognizing the ice machine being in the current ice-making stage.

18. The device according to claim 17, wherein the controlling module is further configured to:

determine that the ice machine is currently operating in a non-ice making mode;

detect a refrigeration request instruction issued by at least one of the refrigerating compartment and the ice-making compartment; and control the connecting direction of the control valve according to the refrigeration request instruction detected and a source of the refrigeration request instruction.

19. A refrigerator, comprising the device for controlling refrigeration of a refrigerator of claim 10.

20. An electronic device for controlling refrigeration of a refrigerator, comprising:

a memory; and a processor, wherein the processor runs a program corresponding to an executable program code by reading the executable program code stored in the memory, the processor configured to recognize a current ice-making stage of an ice machine in the refrigerator;

acquire a current temperature of an ice-making compartment in the ice machine; and control a connecting direction of a control valve in the refrigerator according to the current ice-making stage and the current temperature.

21. The electronic device of claim 20, wherein the memory is a non-transitory computer-readable storage medium.

* * * * *